US006547607B2

(12) United States Patent
Moll et al.

(10) Patent No.: US 6,547,607 B2
(45) Date of Patent: Apr. 15, 2003

(54) CONTACT ELEMENT

(75) Inventors: Roger Moll, Raedersdorf (FR); Jürg Freudiger, Niederbipp (CH)

(73) Assignee: Multi-Holding AG, Allschwil (CH)

( * ) Notice: Subject to any disclaimer, the term of this patent is extended or adjusted under 35 U.S.C. 154(b) by 0 days.

(21) Appl. No.: 09/756,372

(22) Filed: Jan. 8, 2001

(65) Prior Publication Data

US 2001/0019923 A1 Sep. 6, 2001

(30) Foreign Application Priority Data

Jan. 20, 2000 (CH) ..... 0107/00

(51) Int. Cl.[7] ..... H01R 11/22; H01R 4/48
(52) U.S. Cl. ..... 439/816; 439/827; 439/843
(58) Field of Search ..... 439/816, 827, 439/843; 174/35 GC, 927

(56) References Cited

U.S. PATENT DOCUMENTS 4,456,325 A 6/1984 Benz
4,640,979 A * 2/1987 Schmalzl ..... 174/35 GC
4,725,251 A 2/1988 Neidecker et al.
5,203,813 A 4/1993 Fitzsimmons et al.
5,261,840 A * 11/1993 Benz ..... 439/843
5,523,527 A * 6/1996 Mann et al. ..... 174/35 GC
5,769,672 A * 6/1998 Flieger ..... 439/850
5,836,792 A * 11/1998 Thumma et al. ..... 439/736

FOREIGN PATENT DOCUMENTS

CH 572672 2/1976
CH 680759 10/1992

* cited by examiner

*Primary Examiner*—Gary Paumen
*Assistant Examiner*—Felix O. Figueroa
(74) *Attorney, Agent, or Firm*—Tarolli, Sundheim, Covell & Tummino L.L.P.

(57) ABSTRACT

In a contact element (10) for electrically connecting two contact pieces (13, 15, 16, 17) opposing each other with contact surfaces (18), wherein the contact element (10) extends along a longitudinal axis (19) and encompasses numerous separate, identical spring-mounted individual elements (12) that are arranged essentially parallel to each other and transverse to the longitudinal axis (19), which are secured to a continuous carrier band (11) extending in the direction of the longitudinal axis (19), and establish the electrical contact between the contact surfaces, a large working area is achieved while keeping current load capacity high by designing the individual elements as interlaced contact bridges (12).

11 Claims, 7 Drawing Sheets

CONTACT ELEMENT

TECHNICAL AREA

The present invention relates to the field of electrical contacts. It relates to a contact element according to the introductory clause to claim 1.

Such a contact element, in which individual contact webs or contact plates are spring-mounted to a metal sheet band, is manufactured and sold by the applicant under the type designation "MC contact lamella LACu", or is described in U.S. Pat. No. 4,456,325.

PRIOR ART

Lamellar contact elements or contact lamellae available primarily in two variants have proven themselves in the area of technology relating to electrical contacts for transmission of high currents. In one (single-piece) variant, the entire contact lamella is stamped out of a sheet strip, and molded in such a way as to yield a continuous row of individual contact webs projecting out of the sheet strip plane and sprung by torsion, which are interlinked by continuous lateral webs. If the contact webs are designed symmetrically to the longitudinal axis, the tolerance existing between two contact pieces that can still be bridged by the contact lamella depends on the width of the contact webs. The wider the webs twisted around their longitudinal axis, the higher the tolerance that can be bridged with them. Since the number of webs per length unit of contact lamella, and hence the number of contact points between the contact pieces, diminishes given an increasing width of the contact webs, the level of transmittable currents simultaneously decreases as the size of the bridgeable tolerance rises. To resolve this dilemma, it has already been suggested in the past (e.g., see EP-B1-0 520 950) that the contact webs be designed asymmetrically and interleaved in such a way that the bridgeable tolerance can be increased without having to change the number of webs per unit of length.

In the other variant as known from the production program of the applicant or publication cited at the outset, the functions of spring mounting and contacting are separated. Contact is established via individual, massive and electrically well conducting webs or plates (e.g., Cu or Ag), which are secured to a correspondingly stamped carrier band for purposes of fixation and spring mounting. Even though the functional separation of spring mounting and contacting and associated freedom in material selection in this variant enables an elevated flexibility in layout and simpler optimization of the contacting and resilience properties of the contact lamella, the previously used massive, essentially rectangular contact plates have made it impossible to arrive at higher bridgeable tolerances, and hence to expand the sphere of application of these contact lamellae, at a constant current transfer capacity.

DESCRIPTION OF THE INVENTION

Therefore, the object of the invention is to further develop a contact lamella consisting of a shared carrier band and numerous individual contact elements attached thereto in such a way that it allows a distinctly greater tolerance compensation without diminishing the current transfer capacity.

The object is achieved through, the entirety of features of the invention. The essence of the invention lies in the fact that individual elements are designed as interlaced contact bridges. Interlacing makes it possible to vary the effective width of the individual contact elements, and hence the bridgeable tolerance, within broad limits, without having to alter the periodicity or number per unit of length of the individual elements. Since the individual contact elements or contact bridges can be formed independently from the stamping of the carrier band, optimized geometries for the contact bridges can be realized in a simple manner.

A first preferred embodiment of the invention is characterized by the fact that the contact bridges are essentially V shaped with two free ends and a central bend lying in between, and that the free ends of the contact bridges are secured to the carrier band in such a way that their central bend lies at a predetermined height over the carrier band. In particular, the surface clamped by the V shaped contact bridges is inclined relative to the plane of the carrier band, and the carrier band is designed in such a way that the contact bridges attaché thereto can be resiliently moved toward the carrier band with their central bend. The V shaped bent bridges are easy to manufacture, and their central bend ensures a definite contacting.

The carrier band is preferably divided into individual band sections sequentially arranged in the direction of the longitudinal axis, wherein each band section is allocated a contact bridge, and each band section encompasses two spring-mounted arms that extend from a central web running in the central axis of the carrier band transverse to the longitudinal axis, whose two free ends are secured to the free ends of the accompanying contact bridges. This gives rise to particularly good resilience properties.

A second preferred embodiment of the contact element according to the invention is characterized by the fact that the contact bridges each consist of a wire section, and that, for attaching a contact bridge to the carrier band, the free ends of the contact bridge are routed from one side through recesses in the carrier band and clamped with the carrier band by bending the ends projecting through the recesses to the other side. The advantage to this is that the contact lamella can consist of very simple elements that can be rigidly bonded together without any special additional means.

One alternatively preferred embodiment of the invention is characterized by the fact that the contact bridges are made out of parts stamped out of sheet steel, that, for attaching a contact bridge to the carrier band, the free ends of the contact bridges each have a clamping foot with which it is clamped to the accompanying spring-mounted arm, that the contact bridges are essentially flat stamped parts, that the spring-mounted arms can be turned around their longitudinal axis to incline the contact bridges relative to the plane of the carrier band, and that the contact bridges have an embossed area for purposes of stiffening in the area of the central bend.

It has proven beneficial to arrange the contact bridges in the direction of the longitudinal axis with a contact spacing of several millimeters, preferably 2–8 mm, and to have the deflection of the central bend in the direction of the longitudinal axis relative to the attachment points of the contact bridges to the carrier band with the contact bridges inclined measure several millimeters, preferably about 5–10 mm.

Additional embodiments are described in the subclaims.

BRIEF EXPLANATION OF FIGURES

The invention will be described in greater detail below based on embodiments in conjunction with the drawing. Shown on.

WAYS FOR IMPLEMENTING THE INVENTION

Figure 1:
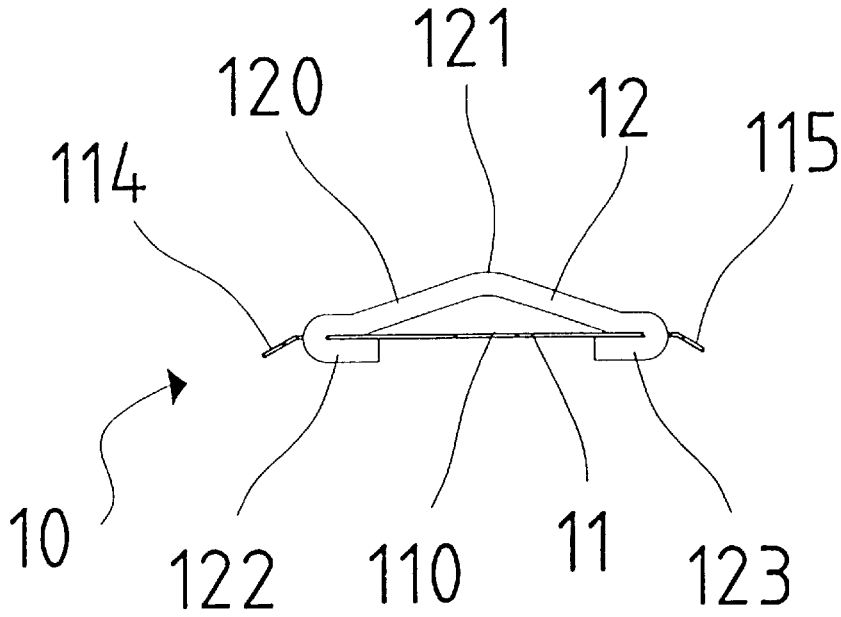
FIG. 1 is a preferred first embodiment of a contact element according to the invention, side view along the longitudinal axis.
Figure 2:
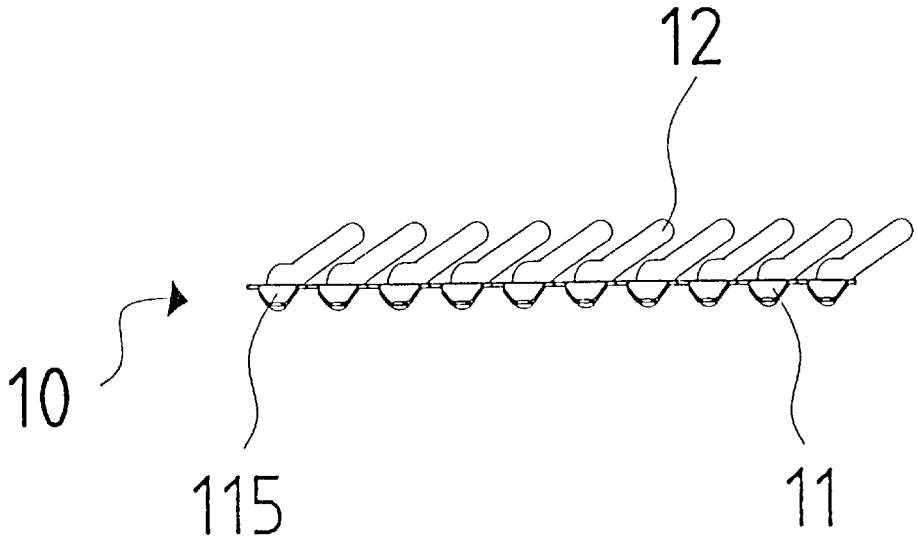
FIG. 2 is the contact element from FIG. 1, side view transverse to the longitudinal axis.

FIGS. 1 to 4 show a first preferred embodiment for a contact element (contact lamella) according to the invention in different views (side view, top view, perspective view). The contact element 10 consists of a carrier band 11 made out of stamped sheet steel with good resilience properties and numerous V-shaped, bent contact bridges 12, which are each bent from a piece of electrically readily conductive, mechanically stable wire comprised of a metal or metal alloy, i.e., a wire section 120. The carrier band 11 is divided into a central web 110 running in the direction of the longitudinal axis 19 and numerous band sections 111 with parallel spring-mounted arm pairs 112, 113, which extend to the outside in the band section 111 to either side of the central web 110, perpendicular to the latter. Each pair of spring-mounted arms 112, 113 is allocated to one of the contact bridges 12.

Each of the V-shaped bent contact bridges 12 has a central bend 121 in the form of a kink. The free ends of the wire section 120 are routed down through the corresponding recesses 116, 117 in the end areas of the spring-mounted arm pairs 112, 113 and bent to the inside, so that they run parallel to the carrier band 11 there as clamping feet 122, 123. At the same time, the corresponding section of the contact bridge 12 is pressed on the carrier band 11 on the top of the carrier band 11, so that the contact bridge is reliably and permanently press molded to the carrier band 11 or spring-mounted arms of the respective spring-mounted arm pair 112, 113. This simultaneously ensures that the currents to be relayed from the contact element 10 are routed exclusively through the contact bridge 12, namely from the central bend 121 to the clamping feet 122, 123 or vice versa. The recesses 116, 117 can take the form of holes in the spring-mounted arms 112, 113. However, it is especially favorable for the automatic production of contact elements 10 if the recesses 116, 117, as shown on the figures, are designed as depressions into which the contact bridges 12 can be inserted from the side.

The contact bridges 12 are interlaced on the carrier band 11, and their free ends are attached to the carrier band 11 in such a way that their central bend 121 lies at a predetermined height over the carrier band 11. The surface clamped by the V-shaped contact bridges 12 is here oriented at an angle of inclination diagonal to the plane of the carrier band 11. The height of the central bend 121 over the carrier band 11 as determined by the angle of inclination and length of the wire section 120 is critical for the tolerance between two contact pieces maximally bridgeable by the contact element 10. The inclined contact bridges 12 attached to the carrier band 11 can be resiliently moved toward the carrier band 11 with their central bend 121 during use primarily because the accompanying spring-mounted arms 112, 113 turn around their longitudinal axis during such a movement, and act as torsion springs.

To enable the transfer of sufficiently high currents via the contact element 10 in practice, it has proven beneficial to arrange the contact bridges 12 in the direction of the longitudinal axis 19 with a contact spacing a (FIG. 3) of several millimeters, preferably 2–8 mm.

As already mentioned, the length of the contact bridges 12 can be adapted to the requirements at the work location (tolerance to be bridged) within broad limits. However, it has proven beneficial in practice for inclined contact bridges 12 to have the deflection b (FIG. 3) of the central bend 121 in the direction of the longitudinal axis 19 relative to the attachment points of the contact bridges 12 on the carrier 11 measure several millimeters, preferably about 5–10 mm.

Figure 3:
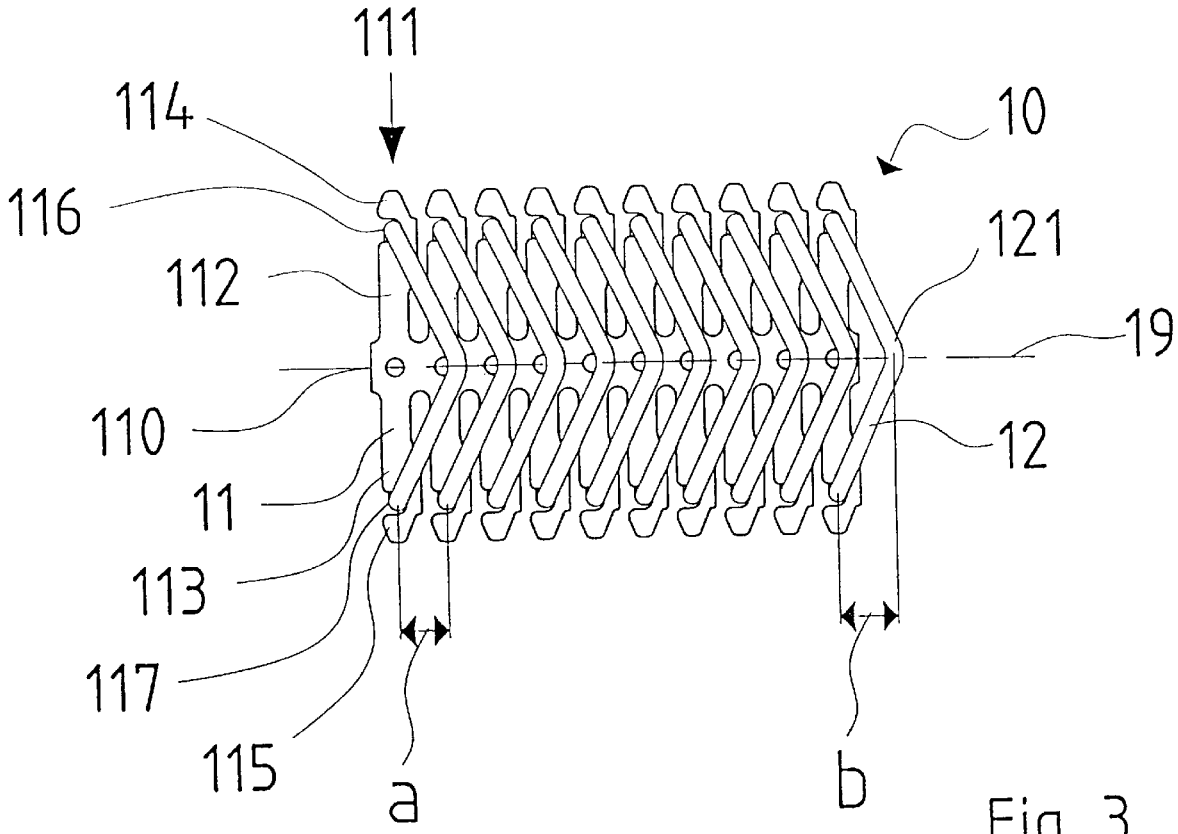
FIG. 3 is the contact element from FIG. 1, top views.
Figure 4:
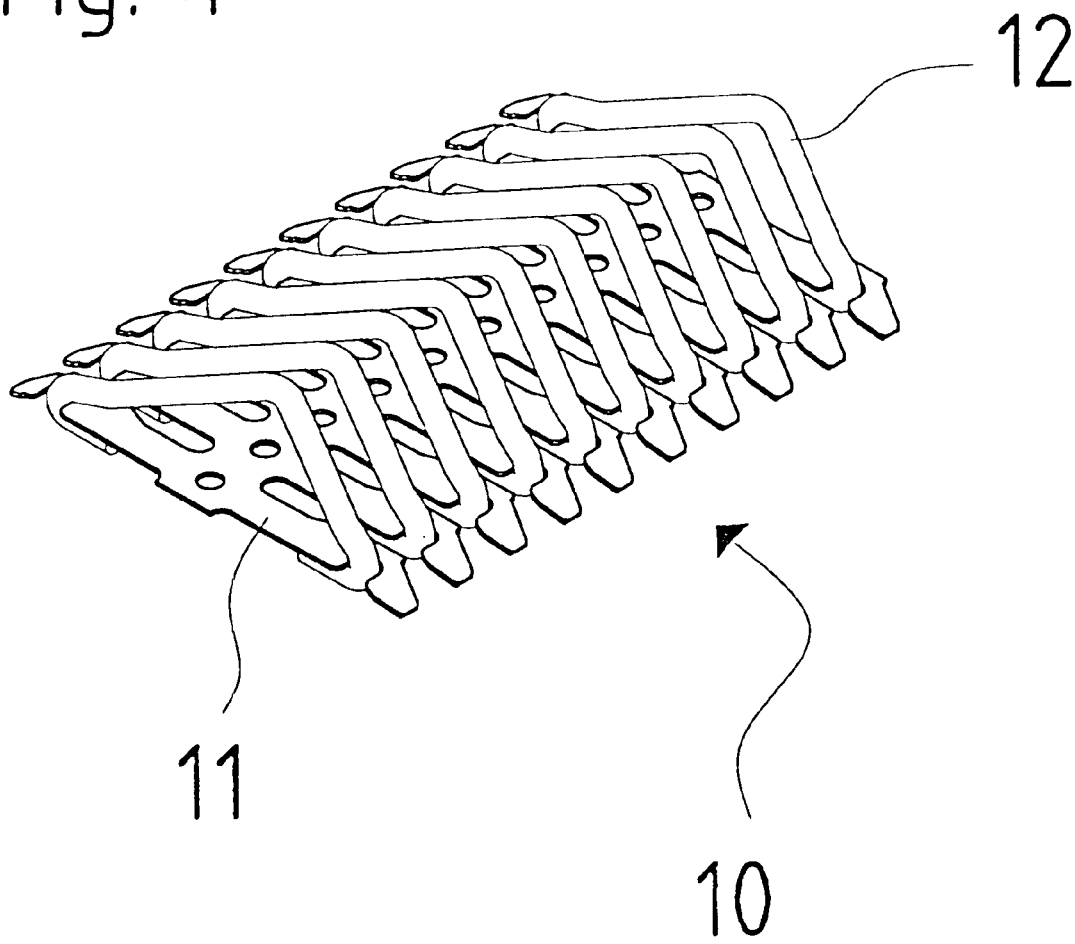
FIG. 4 is a perspective view of the contact element from FIG. 1.
Figure 5:
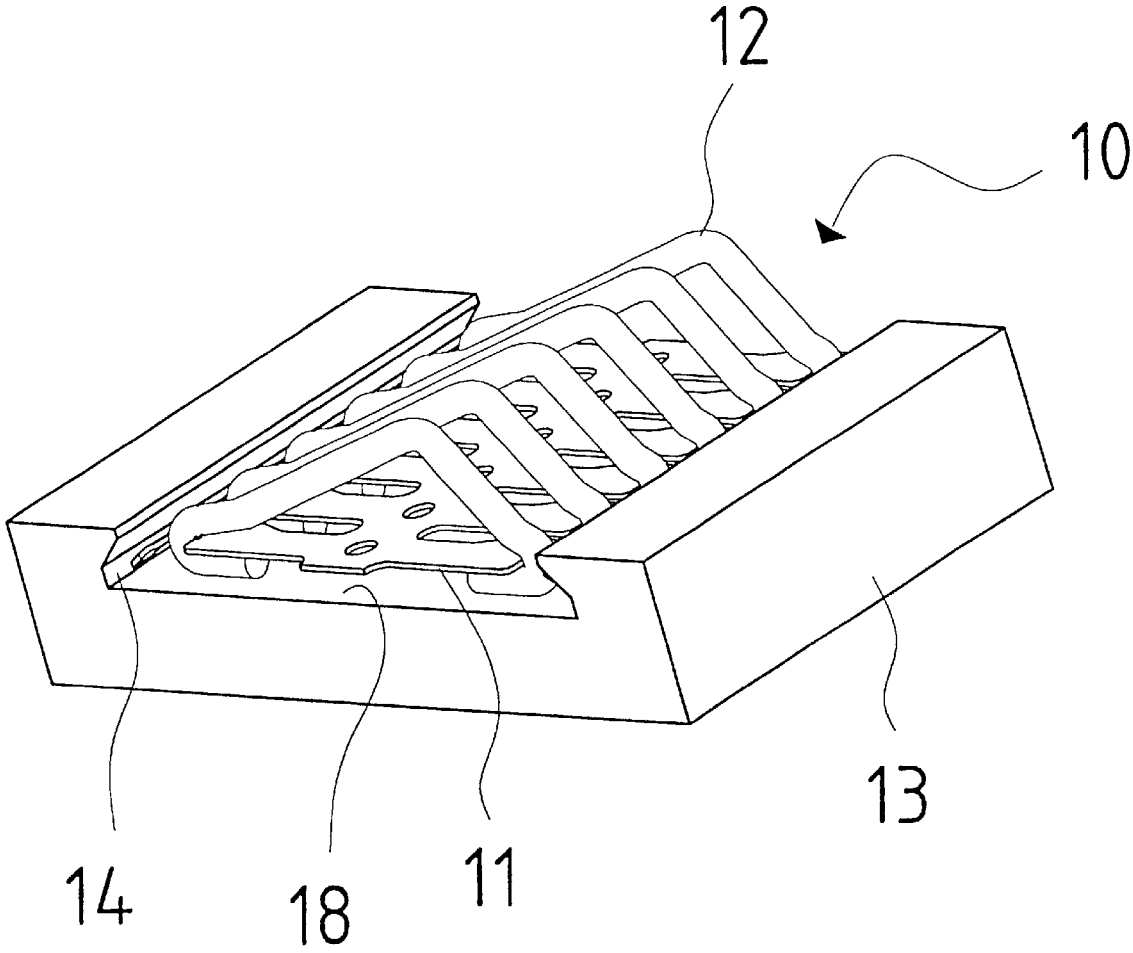
FIG. 5 is a perspective view of the contact element according to FIG. 1 inserted into a dovetailed puncture.
Figure 6:
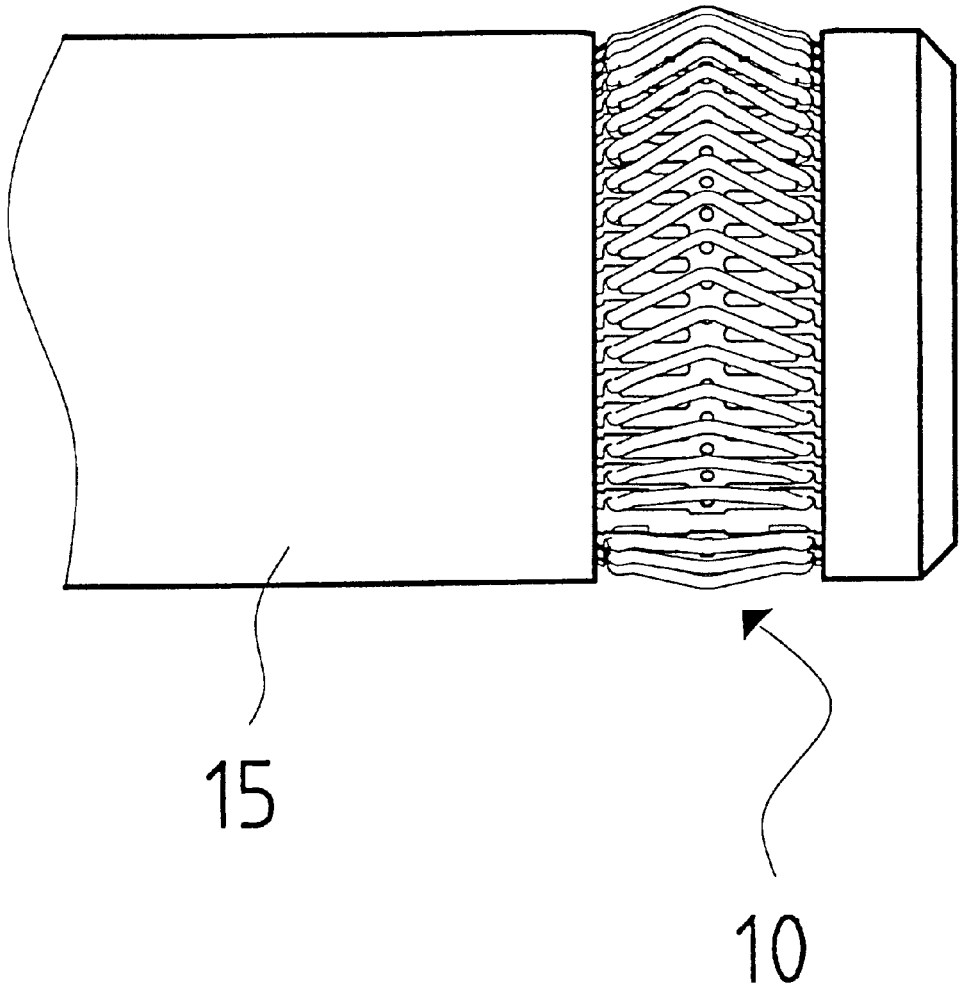
FIG. 6 is the incorporation of a (ring-shaped) contact element according to FIG. 1 on a plug.
Figure 7:
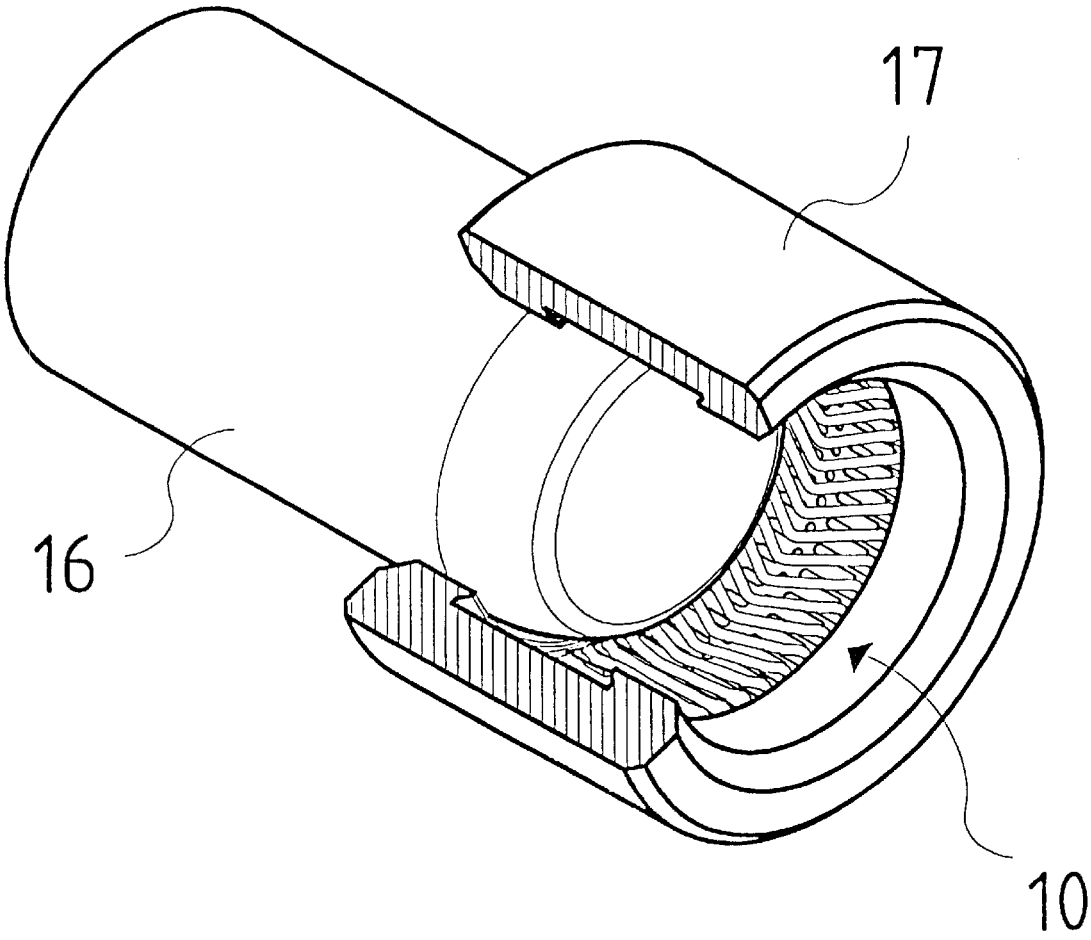
FIG. 7 is the incorporation of a (ring-shaped) contact element according to FIG. 1 on a socket.
Figure 8:
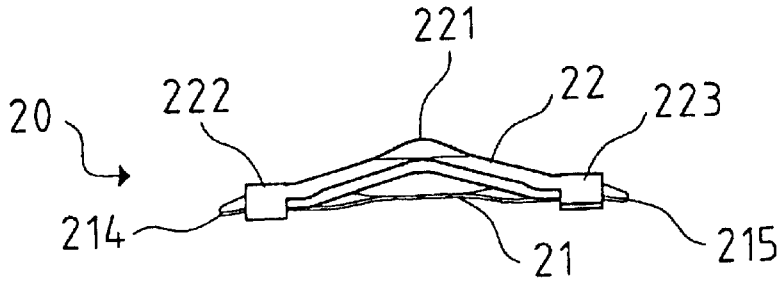
FIGS. 8–11 is a second preferred embodiment of a contact element according to the invention, depictions comparable to FIGS. 1–4.
Figure 9:
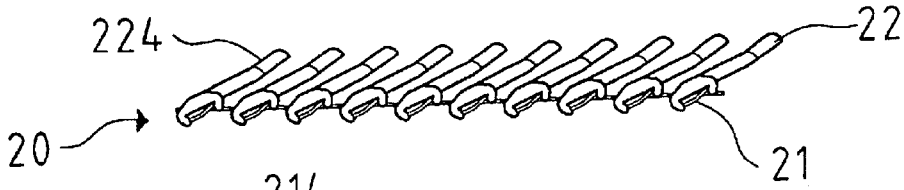
Figure 10:
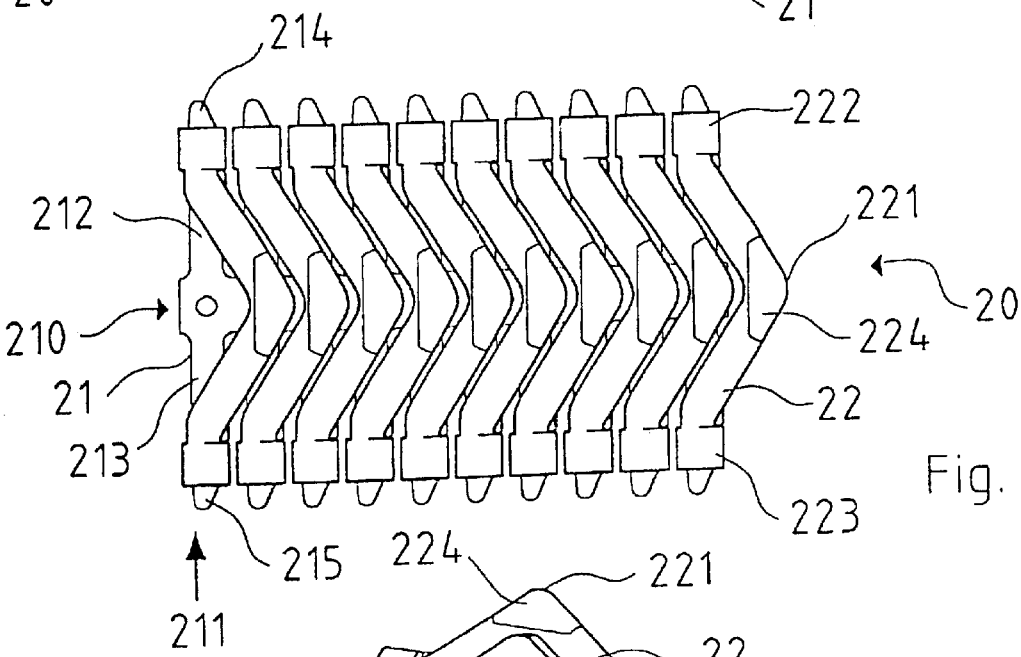
Figure 11:
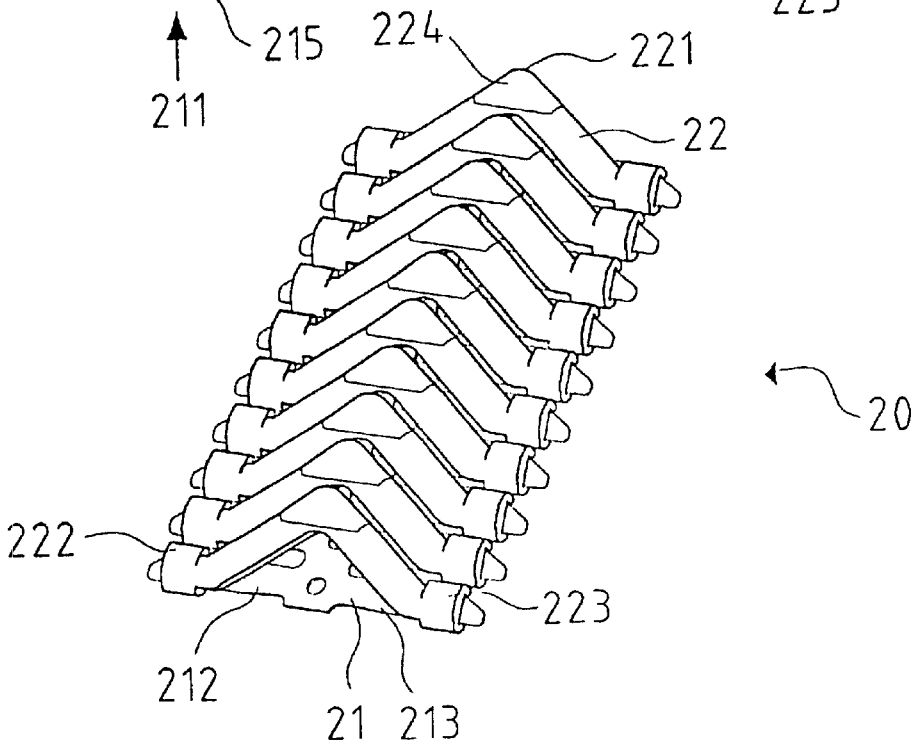

The contact elements 10 are preferably incorporated into a (flat) contact piece 13 or a (round) plug 15 or (round) socket 17 in the manner shown on FIGS. 5 to 7. A puncture 14 with dovetailed cross-sectional profile is provided in the respective contact piece 13 (or 15, 17), into which the contact element 10 is inserted or pushed. To guide the contact element 10 into the puncture 14, the free ends of the spring-mounted arms 112, 113 preferably have guide brackets (114, 115) bent at a right angle (FIG. 3). The floor of the puncture 14 then forms the one contact surface 18 on which the contact bridges 12 rest with their clamping feet 122, 123 (FIG. 4). The opposing (not shown) contact surface is contacted by the central bends 121. In the case of a round plug 15 (FIG. 6), the contact element 10 forms a ring. The same applies to a plug contact made of a plug 16 and socket 17 (FIG. 7), in which the contact element 10 is inserted into the socket 17 with the central bends 121 directed inward.

FIGS. 8 to 11 present pictures of a second preferred embodiment for a contact element according to the invention that are comparable to FIGS. 1 to 4. The contact element 20 again consists of a carrier band 21 made out of stamped sheet steel with good resilience properties and numerous V-shaped, bent contact bridges 22. The contact bridges 22 are now stamped out of sheet steel consisting of an electrically readily conductive, mechanically stable metal or metal alloy. The carrier band 21 is also divided into a central web 210 running in the direction of the longitudinal axis and numerous band sections 211 with parallel spring-mounted arm pairs 212, 213, which extend outwardly to either side of the central web 210, perpendicularly to the latter. Each pair of spring-mounted arms 212, 213 is allocated to one of the contact bridges 22. Guide brackets 214, 215 are located adjacent the spring-mounted arms 212, 213.

Each of the V-shaped stamped contact bridges 22 has a central bend 221. The free ends of the contact bridge 22 has clamping feet 222, 223, with which the contact bridge 22 is reliably and permanently clamped to the spring-mounted arms 212, 213 of the accompanying band section 211.

In this embodiment as well, the contact bridges 22 are interlaced according to the invention on the carrier band 21, wherein their central bend 221 is located at a predetermined height over the carrier band 21. The surface clamped by the V-shaped contact bridges 22 is here oriented at an angle of inclination diagonal to the plane of the carrier band 21. Since the contact bridges 22 are essentially flat stamped parts, the spring-mounted arms 212, 213 are turned around their longitudinal axis (twisted) to incline the contact bridge 22 relative to the plane of the carrier band 21. For stiffening purposes, the contact bridges 22 each have an embossed area 224 near the central bend 221, which results in the area being slightly bent toward the top, as readily visible on FIG. 9. At the same time, this ensures that the electrical contact in the area of the central bend 221 remains defined and largely punctiform, even if the contact bridges 22 are spring-mounted more tightly.

In sum, the new contact element is characterized by the following characteristics and advantages:

It yields a larger working area for bridging large tolerances and angular deviations;

The working area can be enlarged even further by lengthening the lever arm on the contact bridge;

The interlaced arrangement of the contact bridges makes it possible to achieve a low contact spacing, and hence a high current load capacity;

The incorporation width is low, because the hinges of the torsion-stressed spring-mounted arms lie in the middle of the contact element;

A minimal incorporation space (puncture depth) is required;

The separation of spring and contact function yields good resilience properties;

The sliding properties are uniformly low;

Good contacting is achieved via the contact bridges despite a relatively long current path;

A defined 3 point contacting comes about (2 contact points below, 1 contact point above);

The contact element can be used both as a plug or socket lamella (in various diameters) and for flat installation.

REFERENCE NUMBER LIST

| | |
|---|---|
| 10, 20 | Contact element |
| 11, 21 | Carrier band |
| 12, 22 | Contact bridge |
| 13 | Contact piece |
| 14 | Puncture |
| 15, 16 | Plug |
| 17 | Socket |
| 18 | Contact surface |
| 19 | Longitudinal axis |
| 110, 210 | Central web |
| 111, 211 | Band section |
| 112, 113 | Spring-mounted arm |
| 114, 115 | Guide bracket |
| 116, 117 | Recess |
| 120 | Wire section |
| 121, 221 | Central bend (kink) |
| 122, 123 | Clamping foot |
| 212, 213 | Spring-mounted arm |
| 214, 215 | Guide bracket |
| 222, 223 | Clamping foot |
| 224 | Embossed area |
| a | Contact spacing |
| b | Deflection |

What is claimed is:

1. A contact element (10, 20) for electrically connecting two contact pieces (13, 15, 16, 17) opposing each other with contact surfaces (18), wherein the contact element (10, 20) extends along a longitudinal axis (19) and encompasses numerous separate, identical spring-mounted individual elements (12, 22) made of a first material that are arranged essentially parallel to each other and transverse to the longitudinal axis (19), and which are attached to a separate continuous carrier band (11, 21) made of a second material different from said first material extending in direction of the longitudinal axis (19), and establish the electrical contact between the contact surfaces (18), the individual elements being designed as interlaced contact bridges (12, 21), the contact bridges being essentially V-shaped, with two free ends and a central bend (121, 221) lying in between, and wherein the free ends of the contact bridges (12, 22) are secured to the carrier band (11, 21) in such a way that their central bend (121, 221) lies at a predetermined height above the carrier band (11, 21), and a plane defined by the V-shaped contact bridge (12, 22) being oriented at an incline relative to a plane of the carrier band (11, 21) and the carrier band (11, 21) being designed that the contact bridges (12, 22) secured to the carrier band (11, 21) can be resiliently moved toward the carrier band (11, 21) with their central bend (121, 221), the carrier band (11, 21) being divided into individual band sections (111, 211) sequentially arranged in the direction of the longitudinal axis (19), wherein each band section (111, 211) is allocated a contact bridge (12, 22) and wherein each band section (111, 211) encompasses two spring-mounted arms (112, 113; 212, 213) that extend from a central web (110, 210) running in a central axis of the carrier band (11, 21) and transverse to the longitudinal axis (19) whereby the two free ends of said two spring-mounted arms are secured to the free ends of the accompanying contact bridges (12, 22), and guide brackets (114, 115; 214, 215) extending from the free ends of the spring-mounted arms and beyond the contact bridges (12, 22), to guide the contact element (10, 20) into engagement with a dovetailed puncture (14) of the contact piece (13).

2. The contact element according to claim 1, wherein the carrier band (11, 21) with the central web (110, 210) and the spring-mounted arms (112, 113; 212, 213) extending laterally from the central web (110, 210) are made out of a stamped sheet metal.

3. The contact element according to claim 1, wherein the contact bridges (12) each consist of a wire section (120), and that, to attach a contact bridge (12) to the carrier band (11), the free ends of the contact bridge (12) are routed from one side through the recesses (116, 117) in the carrier band (11) and clamped with the carrier band (11) by bending the ends projecting through the recesses (116, 117) to another side.

4. The contact element according to claim 3, wherein the contact bridges (112, 22) consist of an electrically readily conductive metal or metal alloy.

5. The contact element according to claim 1, wherein the contact bridges (12, 22) are arranged in a direction of the longitudinal axis (19) with a contact spacing (a) of several millimeters.

6. The contact element according to claims 5, wherein the contact bridges (12, 22) are arranged in the direction of the longitudinal axis (19) with a contact spacing (a) of 2–8 mm.

7. The contact element according to 1, wherein at the inclined plane defined by the V-shaped contact bridges, the central bend (121, 221) has a deflection (b) in a direction of the longitudinal axis (19) relative to attachment points of the contact bridges (12, 22) to the carrier band (11, 21) which measures several millimeters.

8. The contact element according to claim 7, wherein the deflection (b) measures about 5–10 mm.

9. The contact element according to 1, wherein the contact bridges (22) are made out of stamped sheet parts, and that wherein to attach the contact bridge (22) to the carrier band (21), the free ends of the contact bridges (22) each have a clamping foot (222, 223), with which the contact bridge is clamped on the accompanying spring-mounted arm (212, 213).

10. The contact element according to claims 9, wherein the spring-mounted arms (212, 213) each have a longitudinal axis, and each of the spring-mounted arms is twisted around the longitudinal axis in order to include the contact bridges (22) relative to the plane of the carrier band (21).

11. The contact element according to claims 9, wherein the contact bridges (22) have an embossed area (224) for purposes of stiffening in an area of the central bend (221).

* * * * *

UNITED STATES PATENT AND TRADEMARK OFFICE

CERTIFICATE OF CORRECTION

PATENT NO. : 6,547,607 B2
DATED : April 15, 2003
INVENTOR(S) : Roger Moll et al.

It is certified that error appears in the above-identified patent and that said Letters Patent is hereby corrected as shown below:

Column 5,
Line 65, delete “21” and insert -- 22 --.

Column 6,
Line 50, delete “claims” and insert -- claim --.
Line 53, after “to” insert -- claim --.

Column 7,
Line 1, delete “claims” and insert -- claim --.

Column 8,
Line 1, delete “claims” and insert -- claim --.

Signed and Sealed this

Eleventh Day of November, 2003

JAMES E. ROGAN
*Director of the United States Patent and Trademark Office*